US007527150B2

(12) United States Patent
Tong

(10) Patent No.: US 7,527,150 B2
(45) Date of Patent: May 5, 2009

(54) RATCHET WRENCH HANGING DEVICE HAVING ANTI-THEFT FUNCTION

(76) Inventor: Hui Lin Tong, No. 37, Jong Liau Road, Bei Dou Town, Chang Hua Hsien 521 (TW)

( * ) Notice: Subject to any disclaimer, the term of this patent is extended or adjusted under 35 U.S.C. 154(b) by 470 days.

(21) Appl. No.: 11/499,129

(22) Filed: Aug. 3, 2006

(65) Prior Publication Data

US 2008/0029420 A1 Feb. 7, 2008

(51) Int. Cl.
*B65D 85/28* (2006.01)

(52) U.S. Cl. ..... 206/376; 206/806; 211/70.6; 248/309.1; 248/317

(58) Field of Classification Search ..... 206/349, 206/495, 372, 376, 377, 378, 477, 478, 806; 211/70.6; 248/309.1, 317
See application file for complete search history.

(56) References Cited

U.S. PATENT DOCUMENTS 4,450,961 A * 5/1984 Bies et al. ..... 206/349
6,719,154 B2 * 4/2004 Kao ..... 211/70.6
6,820,742 B1 * 11/2004 Chen ..... 206/378
6,883,767 B1 * 4/2005 Huang ..... 248/317
7,210,663 B2 * 5/2007 Wheeler et al. ..... 248/309.1
7,360,651 B2 * 4/2008 Kuo ..... 206/376
7,424,951 B2 * 9/2008 Hu ..... 206/349
2002/0027092 A1 * 3/2002 Hu ..... 206/378

* cited by examiner

*Primary Examiner*—Luan K Bui
*Assistant Examiner*—Chun Cheung

(57) ABSTRACT

A hanging device for a ratchet wrench includes a base, and an anti-theft mechanism mounted on the base. The anti-theft mechanism includes a first member having a receiving space, a protruding limit post, a plurality of snapping hooks and a first toothed portion, and a second member having a seat portion, a second toothed portion, a catch flange and a mounting stud. Thus, the ratchet wrench is locked by and cannot be detached from the anti-theft mechanism of the hanging device so as to provide an anti-theft function.

17 Claims, 12 Drawing Sheets

RATCHET WRENCH HANGING DEVICE HAVING ANTI-THEFT FUNCTION

BACKGROUND OF THE INVENTION

1. Field of the Invention

The present invention relates to a hanging device, and more particularly to a hanging device for hanging a ratchet wrench to exhibit the ratchet wrench.

2. Description of the Related Art

A conventional hanging device for hanging a ratchet wrench comprises a support board made of wood or metal, and a plurality of hooks mounted on the support board for hanging the ratchet wrench so as to exhibit the ratchet wrench. However, a person can remove the ratchet wrench from the hooks easily, so that the ratchet wrench is easily taken away by a person intentionally.

The closest prior art of which the applicant is aware is disclosed in U.S. Pat. No. 6,378,700-B1. However, the tool can be taken away from the board easily, thereby limiting the anti-theft function.

SUMMARY OF THE INVENTION

The present invention is to mitigate and/or obviate the disadvantage of the conventional hanging device.

The primary objective of the present invention is to provide a ratchet wrench hanging device having an anti-theft function.

Another objective of the present invention is to provide a hanging device, wherein the ratchet wrench is locked by and cannot be detached from the anti-theft mechanism of the hanging device so as to provide an anti-theft function.

In accordance with the present invention, there is provided a ratchet wrench hanging device, comprising:

a base;

an anti-theft mechanism mounted on the base and including:

a first member secured on the base and having an inside formed with a receiving space having a bottom face formed with a protruding limit post, the first member having a plurality of snapping hooks, the first member having a first toothed portion formed in the receiving space;

a second member combined with the first member and having a first end formed with a seat portion, a second end formed with a second toothed portion, and a mediate portion formed with a catch flange located at a connection of the seat portion and the second toothed portion, the seat portion of the second member having an end face formed with a hollow mounting stud having an inside formed with a slot and a periphery formed with at least one locking hole connected to the slot;

a ratchet wrench mounted on the anti-theft mechanism and having an end provided with a mounting post, a positioning ball movably mounted on a periphery of the mounting post, and a retractable rod retractably mounted in the mounting post and detachably rested on the positioning ball to push the positioning ball outwardly or contract the positioning ball inwardly;

wherein when the second member is combined with the first member, the snapping hooks of the first member are hooked onto a surface of the catch flange of the second member, the second toothed portion of the second member are engaged with the first toothed portion of the first member, and the mounting stud of the second member aligns with the limit post of the first member;

wherein the mounting post of the ratchet wrench is inserted into the slot of the second member, the positioning ball of the ratchet wrench is inserted into the locking hole of the second member, and the retractable rod of the ratchet wrench has one end rested on the limit post of the first member.

Further benefits and advantages of the present invention will become apparent after a careful reading of the detailed description with appropriate reference to the accompanying drawings.

DETAILED DESCRIPTION OF THE INVENTION

Figure 1:
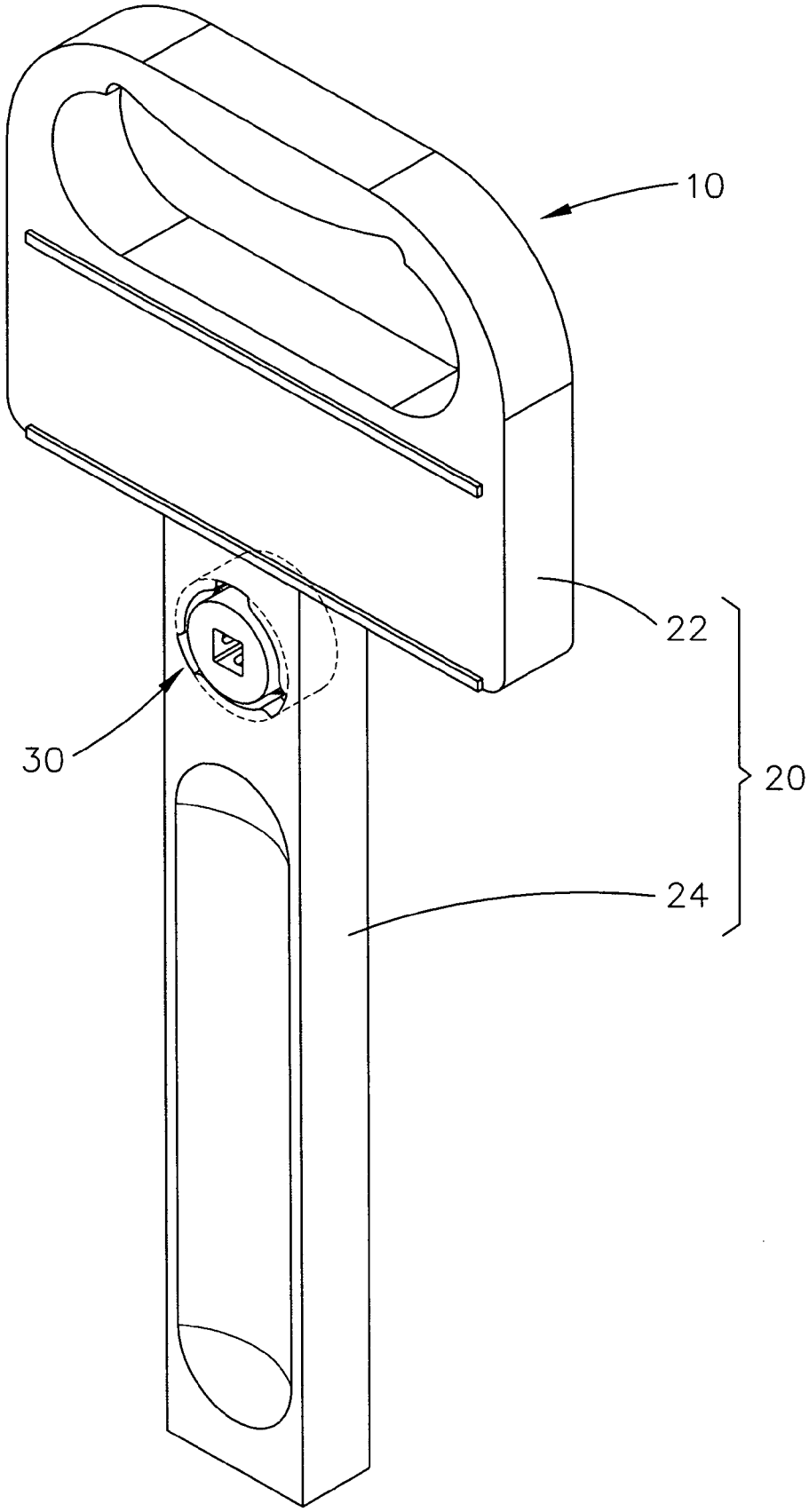
FIG. 1 is a perspective view of a hanging device in accordance with the preferred embodiment of the present invention.

Referring to the drawings and initially to FIG. 1, a hanging device 10 in accordance with the preferred embodiment of the present invention comprises a base 20 having a handle 22 and a hanging bracket 24 extending from a side of the handle 22, and an anti-theft mechanism 30 mounted on and extended through the hanging bracket 24 of the base 20.

Figure 2:
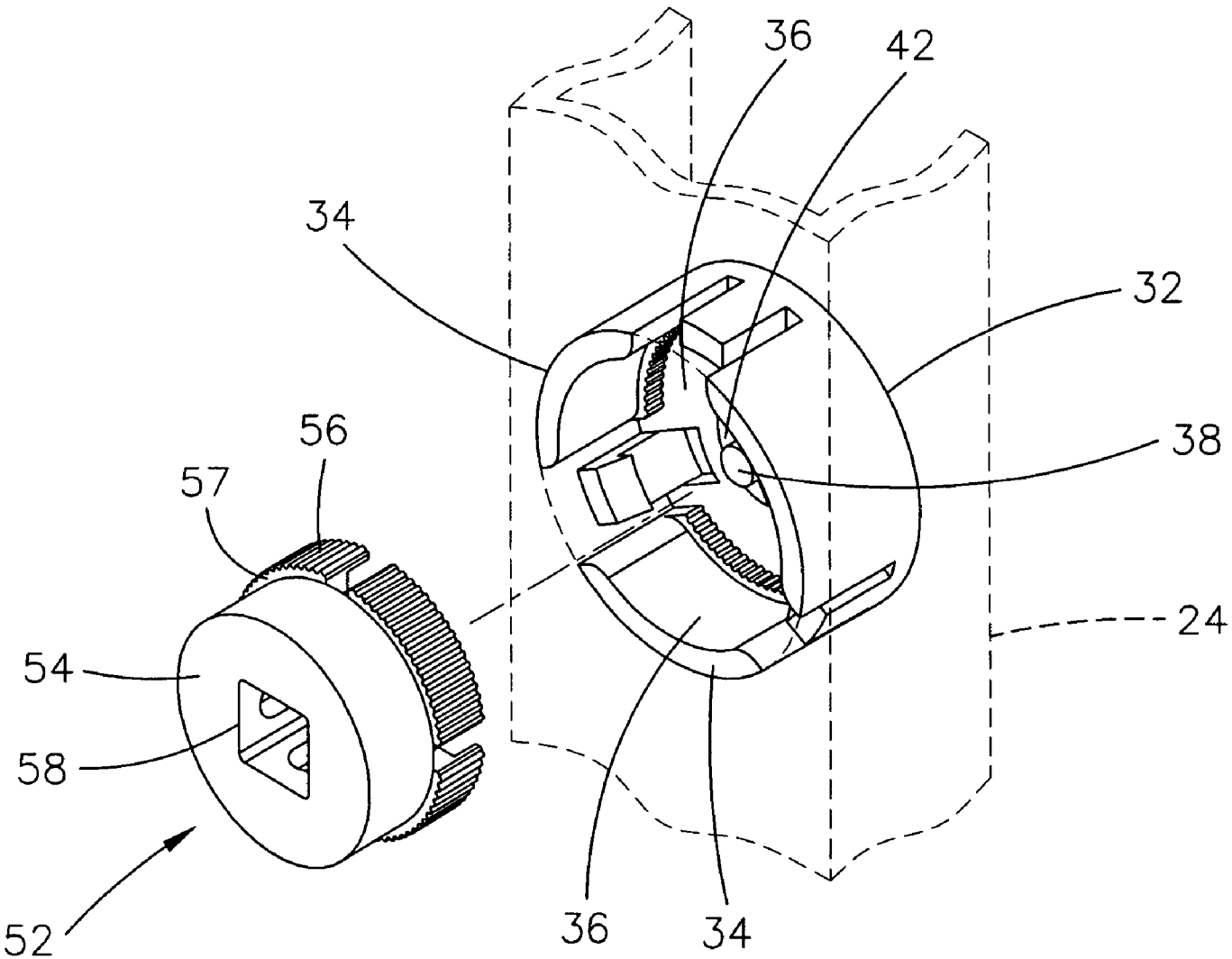
FIG. 2 is an exploded perspective view of an anti-theft mechanism of the hanging device as shown in FIG. 1.
Figure 3:
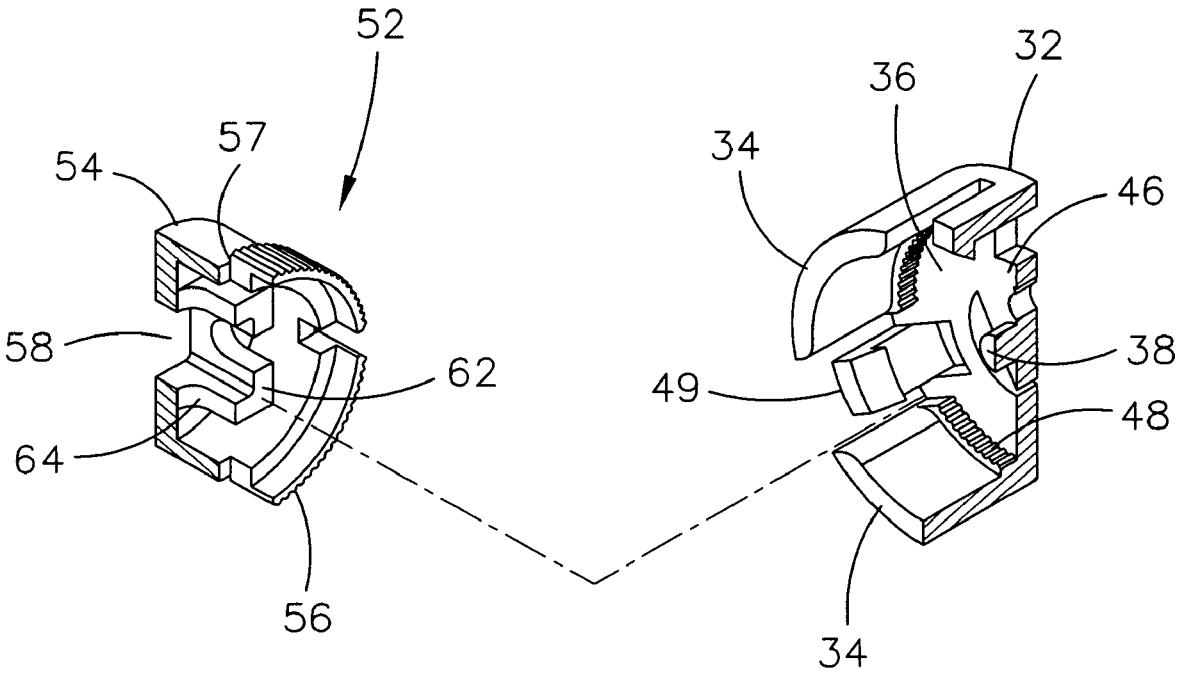
FIG. 3 is an exploded perspective cross-sectional view of the anti-theft mechanism as shown in FIG. 2.

Referring to FIGS. 2 and 3, the anti-theft mechanism 30 includes a first member 32 and a second member 52 combined with the first member 32.

The first member 32 of the anti-theft mechanism 30 is secured on the hanging bracket 24 of the base 20 and has an inside formed with a receiving space 36 having a bottom face formed with a protruding limit post 38. The receiving space 36 of the first member 32 is formed by a plurality of spaced arc-shaped support walls 34. The bottom face of the receiving space 36 has two through holes 42 and 44 (see FIG. 5) and a connecting portion 46 located between the two through holes 42 and 44, and the limit post 38 of the first member 32 is formed on and protruded from a face of the connecting portion 46. The first member 32 of the anti-theft mechanism 30 has a plurality of snapping hooks 49 located between any two adjacent support walls 34. The first member 32 of the anti-theft mechanism 30 has a first toothed portion 48 formed in the receiving space 36 and located at a bottom of each of the support walls 34.

Figure 4:
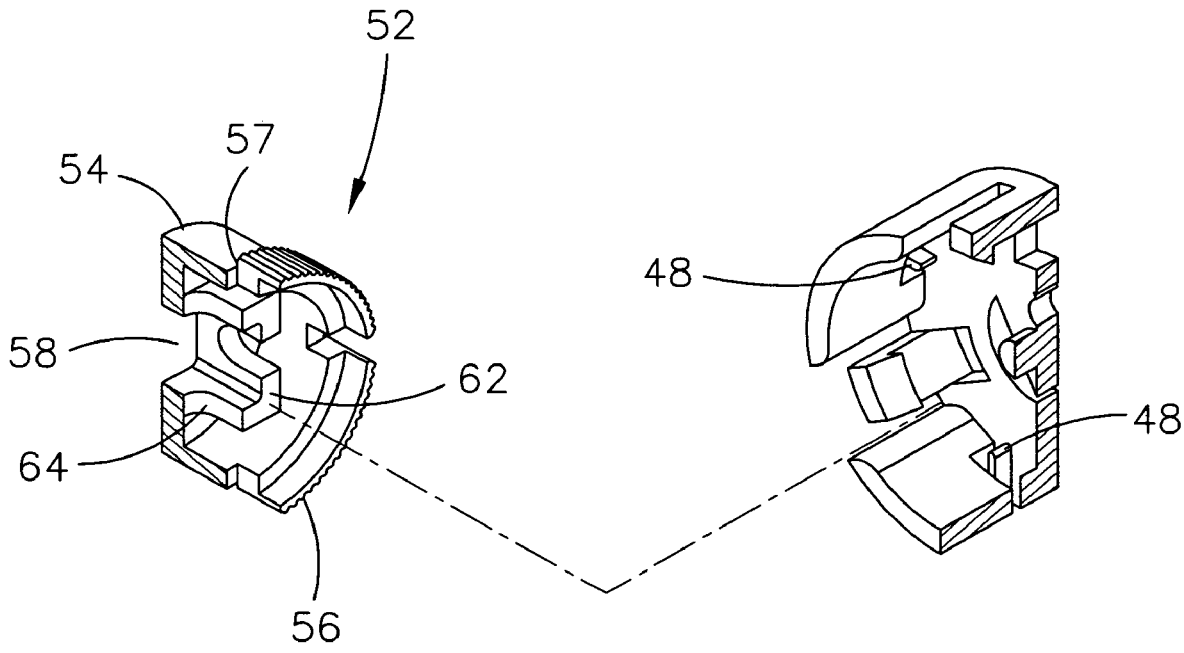
FIG. 4 is an exploded perspective cross-sectional view of an anti-theft mechanism in accordance with another preferred embodiment of the present invention.

Referring to FIG. 4, the first toothed portion 48 of the first member 32 has a single tooth structure.

Again referring to FIGS. 2 and 3, the second member 52 is received in the receiving space 36 of the first member 32. The second member 52 has a hollow inside and has a first end formed with a seat portion 54, a second end formed with a second toothed portion 56 engaged with the first toothed portion 48 of the first member 32, and a mediate portion formed with a catch flange 57 located at a connection of the seat portion 54 and the second toothed portion 56. The seat portion 54 of the second member 52 has an end face formed with a hollow mounting stud 62 having an inside formed with a slot 58 and a periphery formed with a plurality of locking holes 64 each connected to the slot 58. The mounting stud 62 of the seat portion 54 of the second member 52 has a square shape and is extended into the hollow inside of the second member 52 and directed toward the limit post 38 of the first member 32. The slot 58 of the mounting stud 62 of the second member 52 has a square shape and is axially extended through a whole length of the mounting stud 62.

Figure 5:
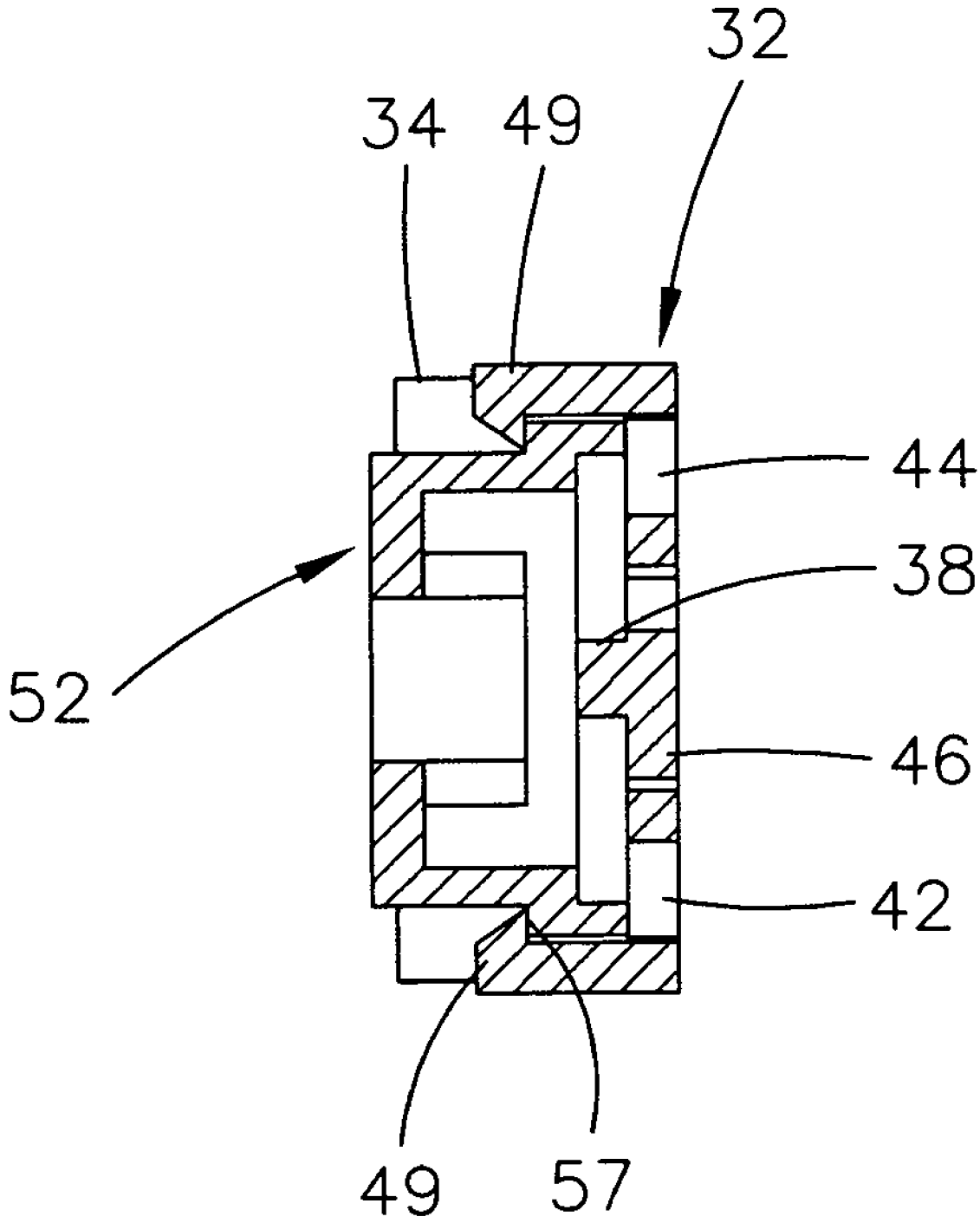
FIG. 5 is a plan cross-sectional assembly view of the anti-theft mechanism as shown in FIG. 2.

Referring to FIG. 5, when the second member 52 is combined with the first member 32, the snapping hooks 49 of the first member 32 are hooked onto a surface of the catch flange 57 of the second member 52.

Figure 6:
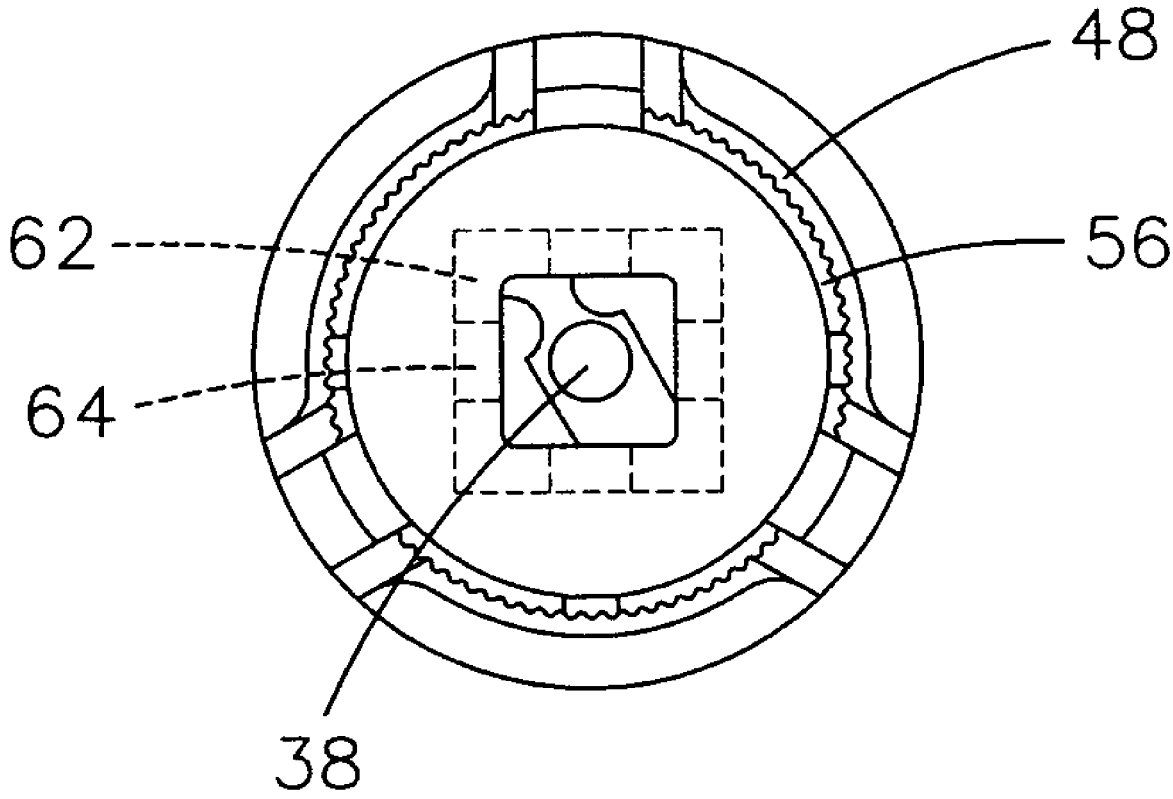
FIG. 6 is a plan assembly view of the anti-theft mechanism as shown in FIG. 2.

Referring to FIG. 6, when the second member 52 is combined with the first member 32, the second toothed portion 56 of the second member 52 are engaged with the first toothed portion 48 of the first member 32, and the mounting stud 62 of the second member 52 aligns with the limit post 38 of the first member 32.

Figure 7:
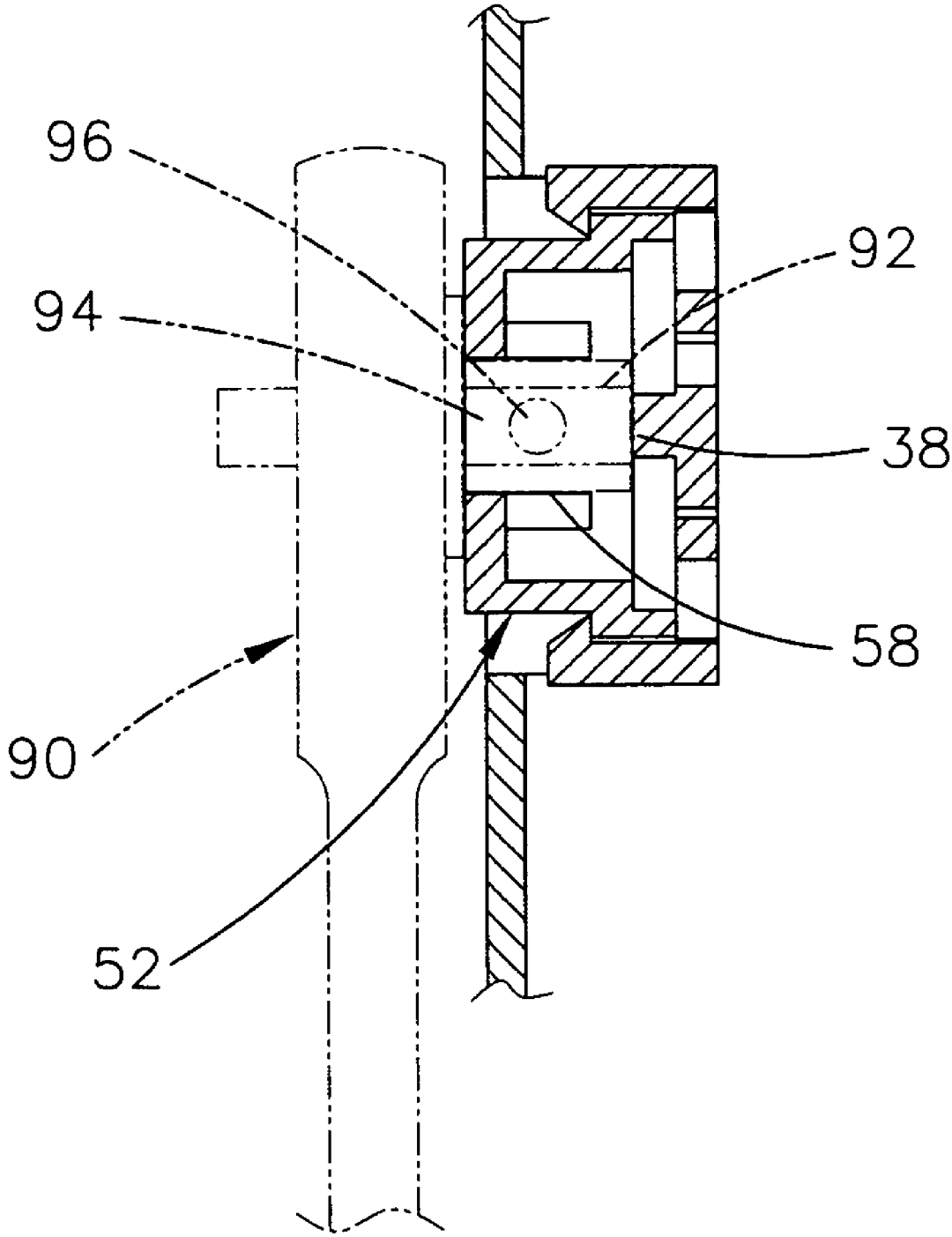
FIG. 7 is a plan cross-sectional assembly view showing the hanging device for a ratchet wrench.

Referring to FIG. 7, a ratchet wrench 90 is mounted on the anti-theft mechanism 30 (see FIG. 1). The ratchet wrench 90 has an end provided with a mounting post 92, a positioning ball 96 movably mounted on a periphery of the mounting post 92, and a retractable rod 94 retractably mounted in the mounting post 92 and detachably rested on the positioning ball 96 to push the positioning ball 96 outwardly or contract the positioning ball 96 inwardly.

Figure 8:
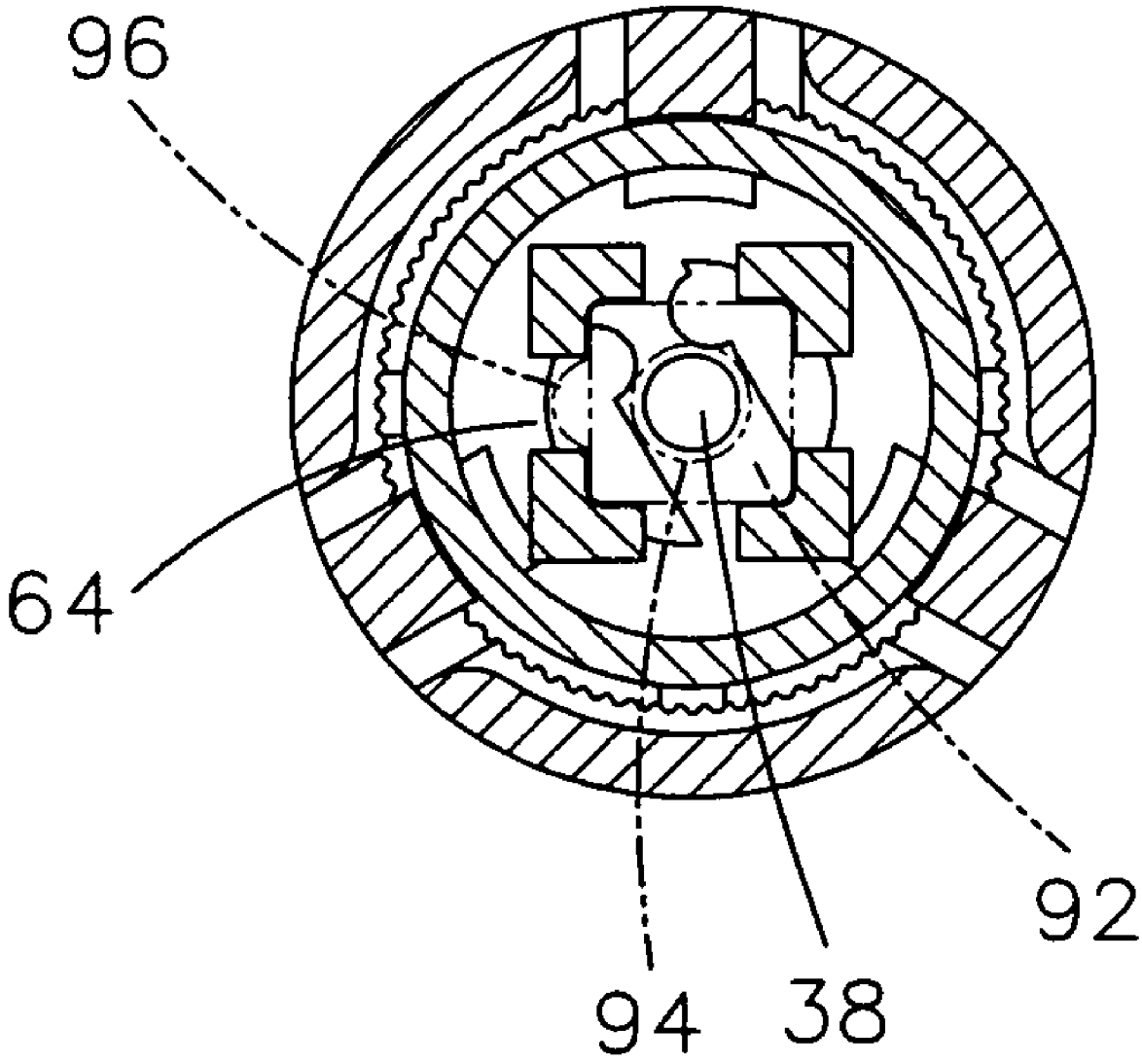
FIG. 8 is a plan cross-sectional assembly view showing the hanging device for a ratchet wrench.

Referring to FIGS. 7 and 8, the mounting post 92 of the ratchet wrench 90 is inserted into the slot 58 of the second member 52, the positioning ball 96 of the ratchet wrench 90 is inserted into one of the locking holes 64 of the second member 52, and the retractable rod 94 of the ratchet wrench 90 has one end rested on the limit post 38 of the first member 32.

Thus, referring to FIGS. 1-8, one end of the retractable rod 94 of the ratchet wrench 90 is limited by the limit post 38 of the first member 32, so that when a force is applied on the other end of the retractable rod 94 of the ratchet wrench 90, the retractable rod 94 of the ratchet wrench 90 is limited by the limit post 38 of the first member 32 and cannot be moved any more. Thus, the positioning ball 96 of the ratchet wrench 90 is limited by the retractable rod 94 and locked in one of the of locking holes 64 of the second member 52, so that the ratchet wrench 90 is locked by the anti-theft mechanism 30 of the hanging device 10 to provide an anti-theft function.

Figure 9:
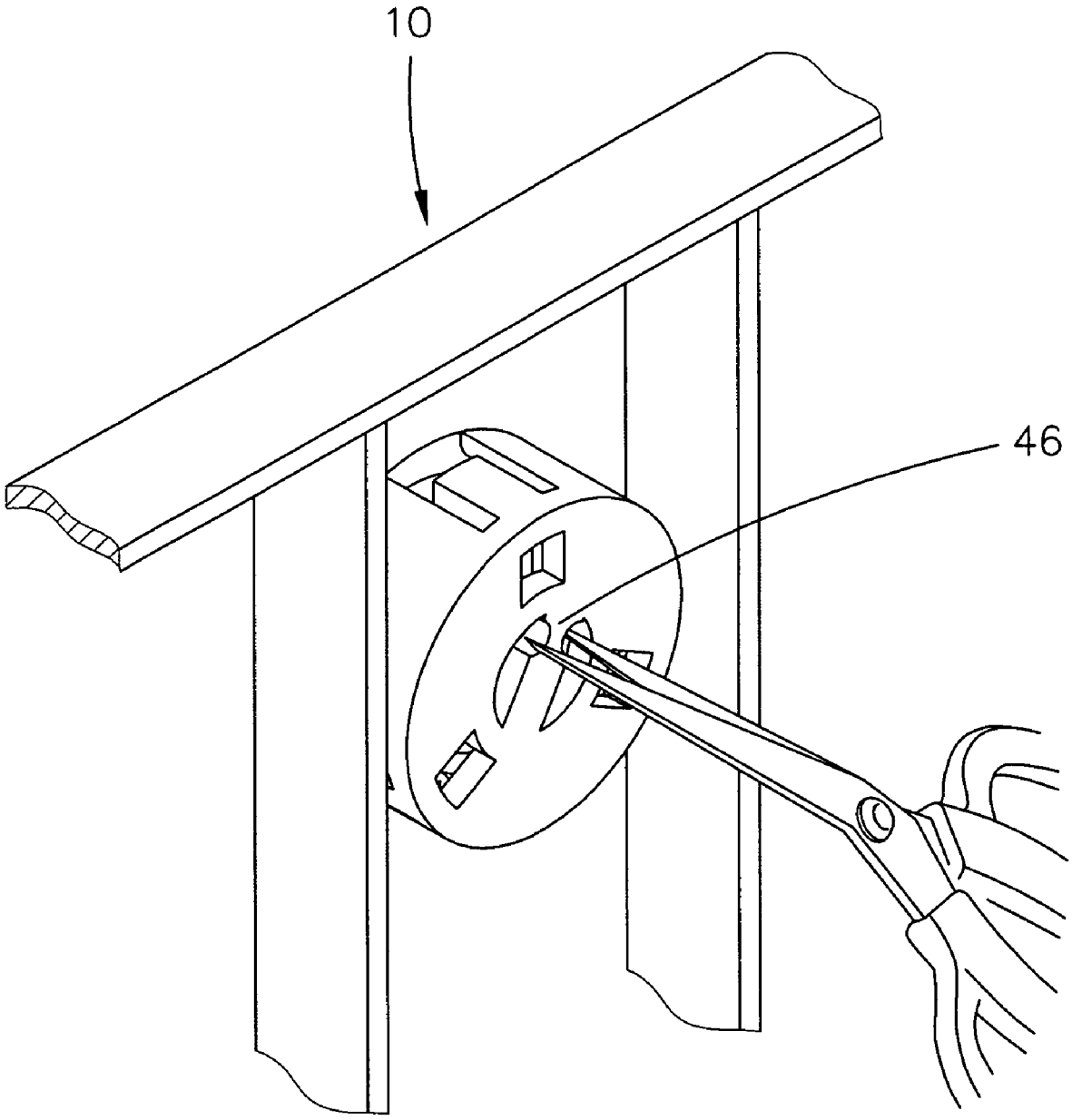
FIG. 9 is a perspective view showing unlocking of the hanging device for a ratchet wrench.
Figure 10:
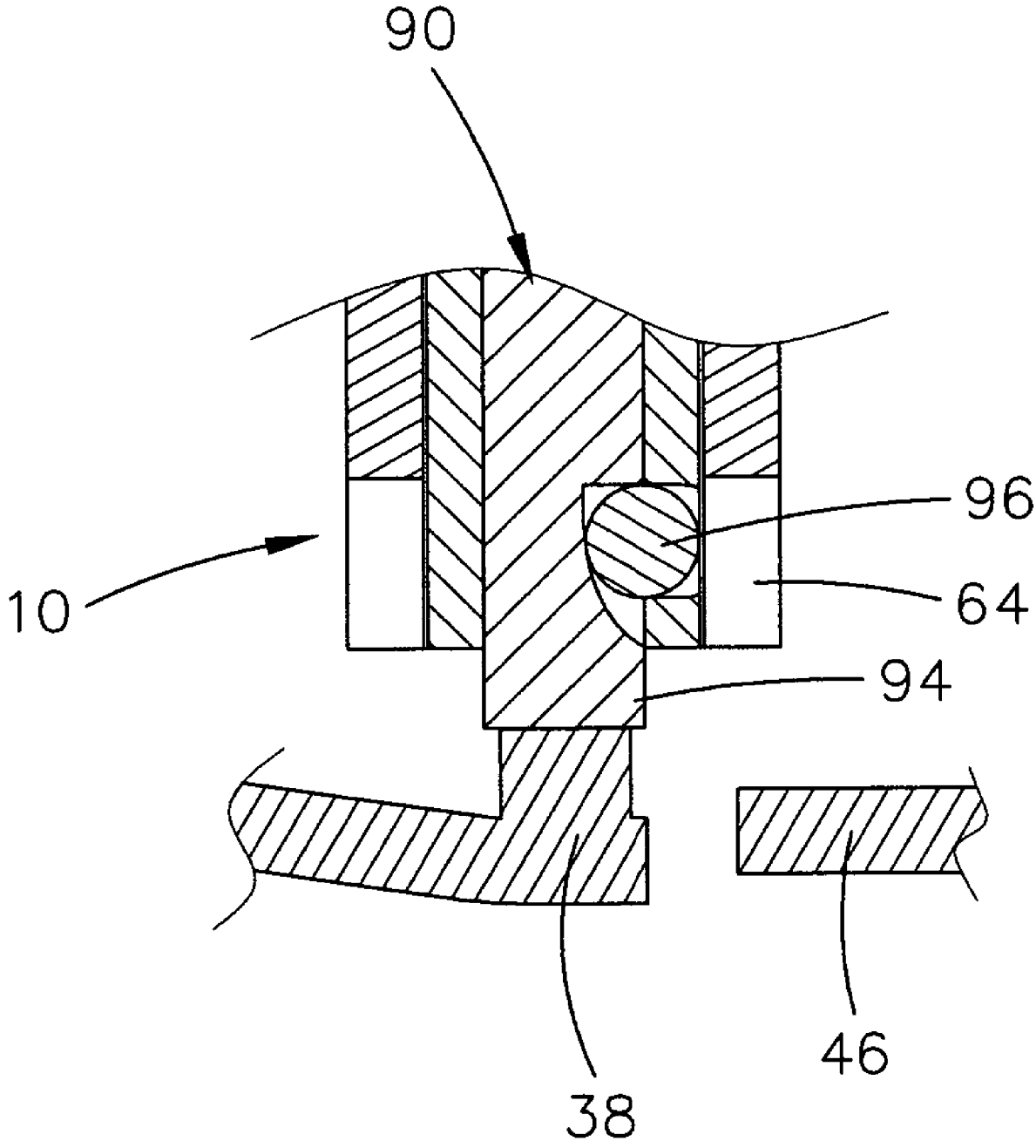
FIG. 10 is a plan cross-sectional view showing unlocking of the hanging device for a ratchet wrench.

Referring to FIGS. 9 and 10, after the connecting portion 46 is cut, the limit post 38 of the first member 32 is located at the free end of a cantilever, so that one end of the retractable rod 94 of the ratchet wrench 90 can be driven to push and move the limit post 38 of the first member 32 to detach the positioning ball 96 of the ratchet wrench 90 from one of the of locking holes 64 of the second member 52, thereby detaching the ratchet wrench 90 from the anti-theft mechanism 30 of the hanging device 10.

Figure 11:
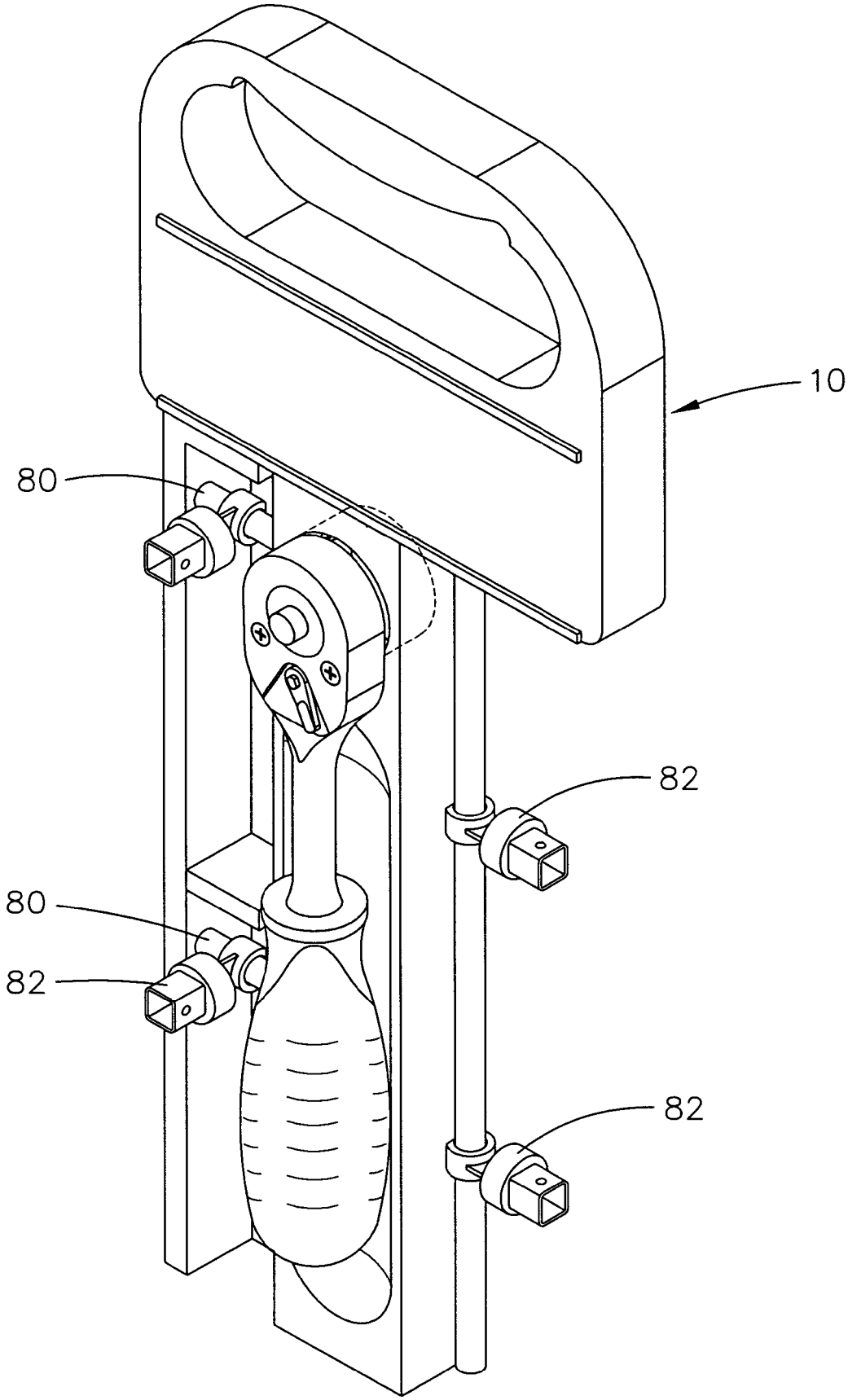
FIG. 11 is a perspective view of a hanging device in accordance with another preferred embodiment of the present invention.

Referring to FIG. 11, the hanging device 10 has a side provided with a plurality of tracks 80 each provided with at least one connector 82 for mounting a socket (not shown).

Figure 12:
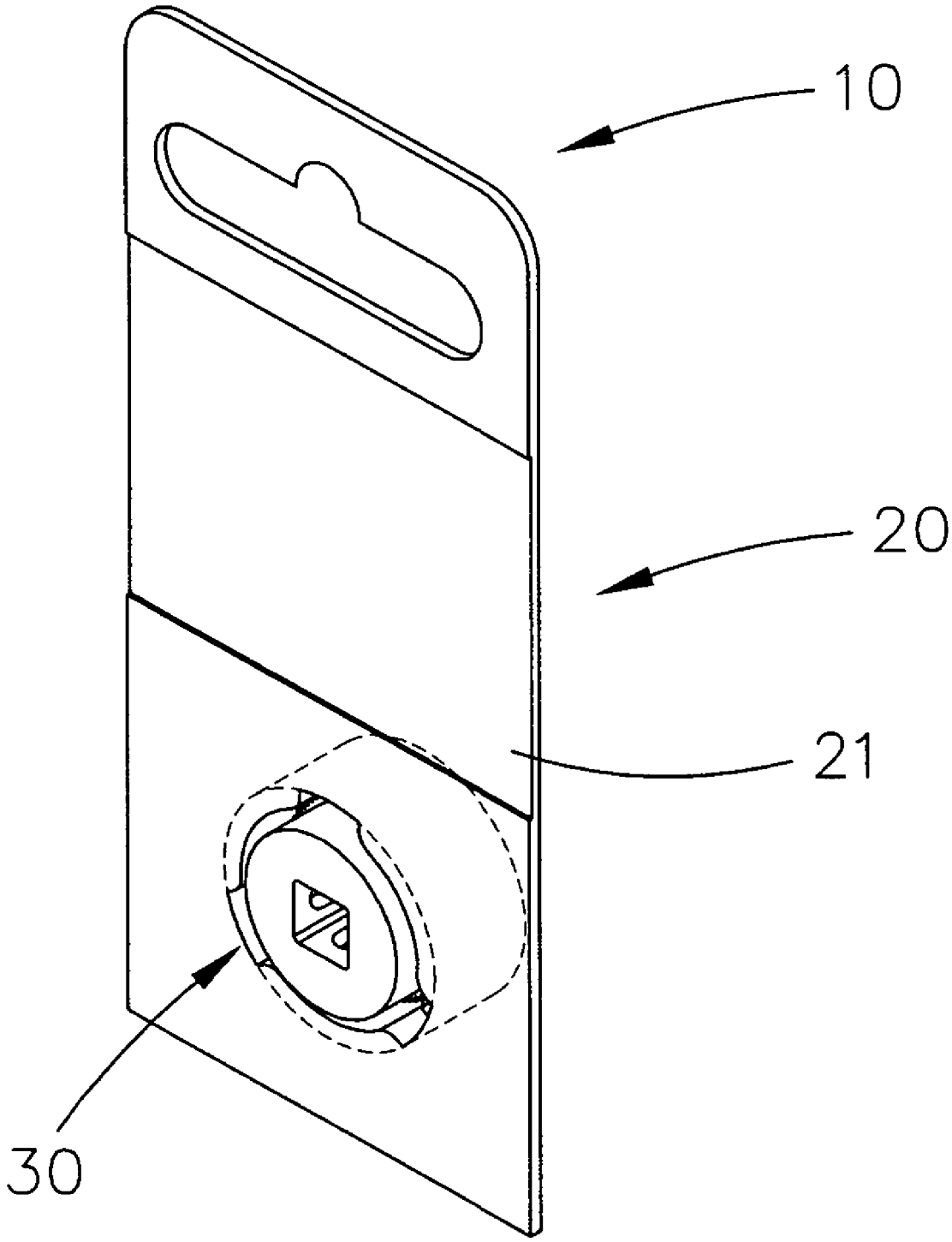
FIG. 12 is a perspective view of a hanging device in accordance with another preferred embodiment of the present invention.

Referring to FIG. 12, the base 20 of the hanging device 10 is a plate 21, and the anti-theft mechanism 30 is mounted on the plate 21. In addition, the plate 21 functions as an indication plate.

Accordingly, the ratchet wrench 90 is locked by and cannot be detached from the anti-theft mechanism 30 of the hanging device 10 so as to provide an anti-theft function.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench hanging device, comprising:

a base;

an anti-theft mechanism mounted on the base and including:

a first member secured on the base and having an inside formed with a receiving space having a bottom face formed with a protruding limit post, the first member having a plurality of snapping hooks, the first member having a first toothed portion formed in the receiving space;

a second member combined with the first member and having a first end formed with a seat portion, a second end formed with a second toothed portion, and a mediate portion formed with a catch flange located at a connection of the seat portion and the second toothed portion, the seat portion of the second member having an end face formed with a hollow mounting stud having an inside formed with a slot and a periphery formed with at least one locking hole connected to the slot;

a ratchet wrench mounted on the anti-theft mechanism and having an end provided with a mounting post, a positioning ball movably mounted on a periphery of the mounting post, and a retractable rod retractably mounted in the mounting post and detachably rested on the positioning ball to push the positioning ball outwardly or contract the positioning ball inwardly;

wherein when the second member is combined with the first member, the snapping hooks of the first member are hooked onto a surface of the catch flange of the second member, the second toothed portion of the second member are engaged with the first toothed portion of the first member, and the mounting stud of the second member aligns with the limit post of the first member;

wherein the mounting post of the ratchet wrench is inserted into the slot of the second member, the positioning ball of the ratchet wrench is inserted into the locking hole of the second member, and the retractable rod of the ratchet wrench has one end rested on the limit post of the first member.

2. The ratchet wrench hanging device in accordance with claim 1, wherein the receiving space of the first member is formed by a plurality of spaced arc-shaped support walls.

3. The ratchet wrench hanging device in accordance with claim 1, wherein the bottom face of the receiving space has two through holes and a connecting portion located between the two through holes.

4. The ratchet wrench hanging device in accordance with claim 3, wherein the limit post of the first member is formed on and protruded from a face of the connecting portion.

5. The ratchet wrench hanging device in accordance with claim 2, wherein the snapping hooks of the first member are located between any two adjacent support walls.

6. The ratchet wrench hanging device in accordance with claim 2, wherein the first toothed portion of the first member is located at a bottom of each of the support walls.

7. The ratchet wrench hanging device in accordance with claim 1, wherein the first toothed portion of the first member has a single tooth structure.

8. The ratchet wrench hanging device in accordance with claim 1, wherein the second member is received in the receiving space of the first member.

9. The ratchet wrench hanging device in accordance with claim 1, wherein the second member has a hollow inside.

10. The ratchet wrench hanging device in accordance with claim 1, wherein the mounting stud of the seat portion of the second member has a square shape.

11. The ratchet wrench hanging device in accordance with claim 1, wherein the mounting stud of the seat portion of the second member is extended into the hollow inside of the second member and directed toward the limit post of the first member.

12. The ratchet wrench hanging device in accordance with claim 1, wherein the slot of the mounting stud of the second member has a square shape.

13. The ratchet wrench hanging device in accordance with claim 1, wherein the slot of the mounting stud of the second member is axially extended through a whole length of the mounting stud.

14. The ratchet wrench hanging device in accordance with claim 1, wherein the base has a handle and a hanging bracket extending from a side of the handle, and the anti-theft mechanism is mounted on and extended through the hanging bracket of the base.

15. The ratchet wrench hanging device in accordance with claim 14, wherein the first member of the anti-theft mechanism is secured on the hanging bracket of the base.

16. The ratchet wrench hanging device in accordance with claim 1, wherein the anti-theft mechanism is extended through the base.

17. The ratchet wrench hanging device in accordance with claim 1, wherein the base is a plate, and the anti-theft mechanism is mounted on the plate.

* * * * *